United States Patent [19]

Stern et al.

[11] Patent Number: 4,946,416

[45] Date of Patent: Aug. 7, 1990

[54] VEHICLE WITH ELECTRONIC SOUNDER AND DIRECTION SENSOR

[75] Inventors: Carl M. Stern, Pennington; Richard N. Meckstroth, Princeton; Stephen L. Hayes, East Windsor, all of N.J.

[73] Assignee: Innova Development Corporation, Pennington, N.J.

[21] Appl. No.: 431,020

[22] Filed: Nov. 1, 1989

[51] Int. Cl.[5] ..... A63H 5/00; A63H 33/26; A63H 33/22; A63H 30/00

[52] U.S. Cl. ..... 446/409; 446/485; 446/219; 446/175

[58] Field of Search ..... 446/409, 410, 404, 484, 446/485, 434, 431, 448, 397, 269, 270, 272, 289, 291, 292, 219, 175, 91; 273/86 R, 86 B

[56] References Cited

U.S. PATENT DOCUMENTS

| | | | |
|---|---|---|---|
| 1,868,194 | 7/1932 | Cuff | 446/410 |
| 1,956,954 | 5/1934 | Kelch et al. | 446/410 |
| 3,160,984 | 12/1964 | Ryan | 446/397 |
| 3,425,156 | 2/1969 | Field | 446/409 |
| 3,466,797 | 9/1969 | Hellsund | 446/410 |
| 3,664,060 | 5/1972 | Longnecker | 446/410 |
| 3,839,822 | 10/1974 | Rexford | 446/410 |
| 4,055,914 | 11/1977 | Ieda et al. | 446/404 X |
| 4,219,962 | 9/1980 | Dankman et al. | 446/409 |
| 4,265,047 | 5/1981 | Meyer et al. | 446/397 X |
| 4,266,368 | 5/1981 | Nyman | 446/410 |
| 4,274,225 | 6/1981 | Knauff et al. | 446/409 |
| 4,282,680 | 8/1981 | Zaruba | 446/270 |
| 4,291,877 | 9/1981 | Ensmann et al. | 446/409 X |
| 4,432,159 | 2/1984 | Kanno | 446/410 |
| 4,450,772 | 5/1984 | Van Sickle | 446/410 X |
| 4,813,907 | 3/1989 | Rissman et al. | 446/409 X |

FOREIGN PATENT DOCUMENTS

| | | | |
|---|---|---|---|
| 2425427 | 12/1975 | Fed. Rep. of Germany | 446/410 |
| 2625446 | 7/1989 | France | 446/409 |
| WO87/04365 | 7/1987 | PCT Int'l Appl. | 446/91 |
| 2210279 | 6/1989 | United Kingdom | 446/409 |

*Primary Examiner*—Robert A. Hafer
*Assistant Examiner*—D. Neal Muir
*Attorney, Agent, or Firm*—Norman E. Lehrer; Franklyn Schoenberg

[57] ABSTRACT

A toy wheeled vehicle such as a toy truck which is intended to be pushed along by a child includes electronic circuitry which is capable of emitting a plurality of different sounds similar to the sounds of a real truck. The actual sound of a truck's internal combustion engine is digitized and stored in a microprocessor along with other sounds such as those generated by a starter motor, horn, backup beeper and the like. In addition, the microprocessor is capable of synthesizing additional realistic vehicle sounds such as those generated by air brakes and the like. A starter switch first activates the starter motor sound and then the engine sound at idle speed. A speed sensor senses both speed and the direction of travel and varies the engine sound in response to the sensed speed. The backup beeper sound is automatically generated along with the engine sound when the truck is moved in reverse. The microprocessor not only stores all of the digitized sounds but also controls all of the operations of the truck.

16 Claims, 4 Drawing Sheets

VEHICLE WITH ELECTRONIC SOUNDER AND DIRECTION SENSOR

BACKGROUND OF THE INVENTION

The present invention is directed toward a toy wheeled vehicle such as a truck or the like and, more particularly, toward such a vehicle including a microcomputer therein and including means for generating sounds that very closely resemble the sounds of a real truck or other vehicle.

Toy wheeled vehicles having electronic sound generating means therein for simulating the sounds of the vehicle's engine have been known for some time. Such prior systems are primarily intended to be used in connection with model railroad locomotives and are described, for example, in U.S. Pat. Nos. 3,466,797 to Hellsund; 3,664,060 to Longnecker; 3,839,822 to Rexford and 4,266,368 Nyman. In each of these patents, means are also provided for sensing the speed of the locomotive and varying the engine sound in response to the sensed speed.

Furthermore, in each of the above-mentioned patents, the engine sounds are generated artificially. That is, a sound or noise generator is provided which is intended to simulate the sound of the locomotive engine. Thus, a true sound can never really be achieved. Even further, each of the vehicles described in the above patents includes an electric motor for moving the vehicle and is specifically designed to ride on a track which provides power to the electric motor. These vehicles are, therefore, not under the direct control of a child playing with the same but rather are only indirectly controlled through the use of a transformer or the like.

Electronic circuits for providing simulated engine sounds have also been employed with vehicles other than locomotives. U.S. Pat. No. 3,425,156 to Field, for example, describes a toy automobile which includes a relaxation oscillator which generates a simulated engine sound. The car shown in this patent, however, is also intended to ride on a track and the sound generating means is stationary with respect to the track rather than being included in the car. The simulated engine sound is varied based on the voltage to the track irrespective of the actual speed of the car.

Only one prior patent is known to exist which is directed toward a toy vehicle which includes an electronic means for generating simulated vehicle sounds, which does not include an electric motor for propelling the same and which is not specifically designed to ride on a track. U.S. Pat. No. 4,219,962 Dankman et al. is directed toward a toy vehicle which is intended to be pushed by hand and, therefore, under the direct control of a child playing with the same. The Dankman et al. vehicle includes not only engine sound generating means which varies with the speed of the vehicle but also includes means for generating other noises such as the sounds of squealing tires, of a crash or a siren.

Although the proposals set forth in Dankman et al. might be considered to be somewhat of an improvement over the prior art, it still does not result in a realistically sounding toy vehicle. For example, the Dankman et al. circuitry is incapable of producing certain sounds that one would normally expect to hear from a vehicle and particularly from a truck. The patented system does not provide means for generating an electric starter noise nor a backup beeping noise which is common with trucks. These backup beeping noises are automatically generated by a full size truck when it is put in reverse and since Dankman et al. does not provide such a sound, the patent similarly lacks any means for indicating when the vehicle is being moved in a reverse direction.

Furthermore, all of the sounds or noises generated by the Dankman et al. circuitry are artificially created. They are, therefore, not true reproductions of an actual vehicle sounds. Even further, Dankman et al. does not allow more than one sound to be produced at a time. The patent includes a priority gating logic circuit which allows only one sound to pass through to the transducer. Thus, if it is desired to generate the siren sound which is accomplished by pressing a momentary contact switch, the engine simulation sound is inhibited. This obviously is not very realistic as a vehicle riding on a street with its siren sounding simultaneously produces noise from its engine.

There is no known prior toy vehicle or patent or other disclosure describing the same which is under the direct control of a child and which is capable of realistically producing various sounds made by a full size vehicle.

SUMMARY OF THE INVENTION

The present invention is designed to overcome all of the deficiencies of the prior art described above and results in a toy which is capable of emitting very realistic sounds in direct response to a child's manipulation of the toy. The invention provides a toy wheeled vehicle such as a toy truck which is intended to be pushed along by a child and includes electronic circuitry which is capable of emitting a plurality of different sounds similar to the sounds of a real truck. The actual sound of a truck's internal combustion engine is digitized and stored in a microcomputer along with other sounds such as those generated by a starter motor, horn, backup beeper and the like. In addition, other sounds, such as those generated by air brakes, can be generated by the microcomputer in real time as the toy is operated. A starter switch first activates the starter motor sound and then the engine sound at idle speed. A speed sensor senses both speed and direction of travel and varies the engine sound in response to the sensed speed. The backup beeper sound is automatically generated along with the engine sound when the truck is moved in reverse. The microcomputer not only stores all of the digitized sounds but also controls all of the operations of the truck.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
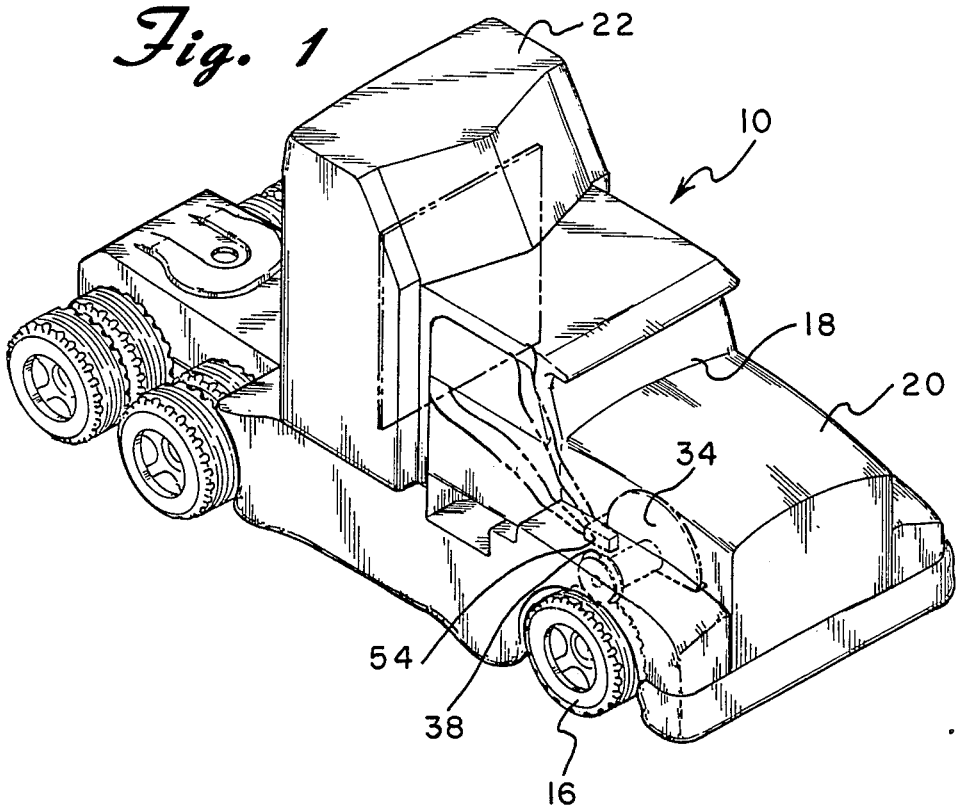
FIG. 1 is a front perspective view of a toy wheeled vehicle in the form of a trailer truck embodying the principles of the present invention.
Figure 2:
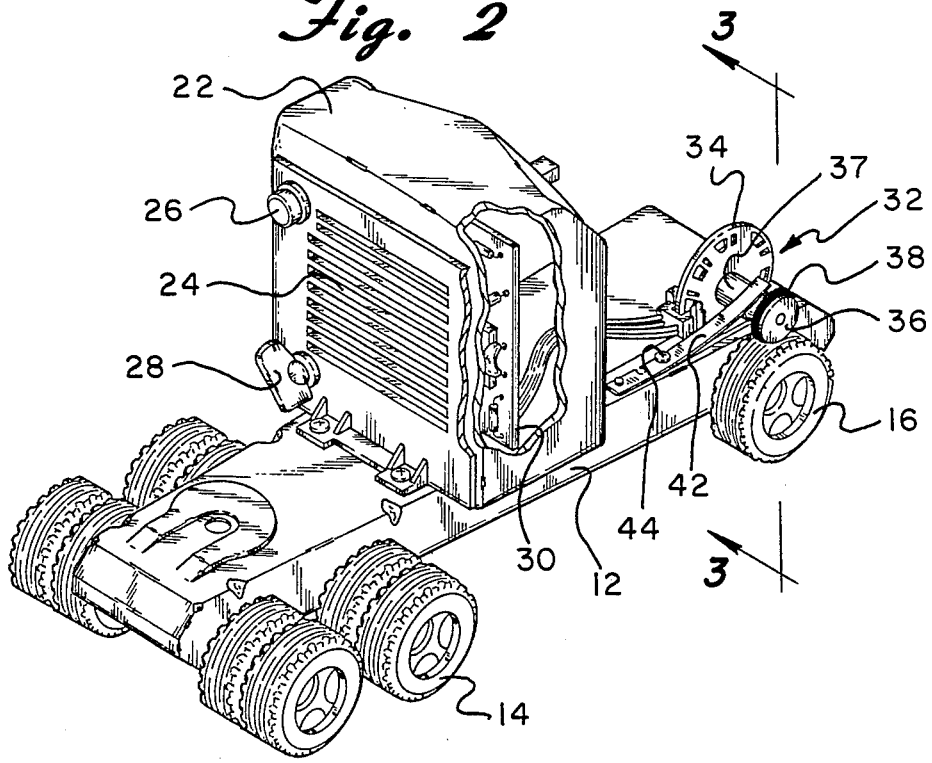
FIG. 2 is a rear perspective view of FIG. 1 with a portion thereof broken away and with a portion of the truck body removed.

Referring now to the drawings in detail wherein like reference numerals have been used throughout the various figures to designate like elements, there is shown in FIGS. 1 and 2 a toy wheeled vehicle constructed in accordance with the principles of the present invention and designated generally as 10. The vehicle 10 is shown as the cab or truck portion of a tractor trailer truck. It will be understood, however, that this is by way of example only. Substantially any type of toy vehicle which is intended to be pushed along by a child can be used as part of the invention. Although the truck 10 is shown generally and somewhat schematically, it preferably will be constructed so as to include many of the details of a full-size vehicle and to be essentially a scale model thereof.

The toy truck 10 includes a chassis 12 to which are mounted rear wheels 14 and front wheels 16 which rotate freely relative to the chassis 12. Mounted to the top forward end of the chassis 12 is a cab 18 and a hood 20. Behind the cab portion 18 is a storage area 22 similar to that mounted behind the cab of a full-size truck.

The storage compartment 22 of the vehicle 10 is used to house the microcomputer and associated electronics of the present invention, the details of which will be described in more detail hereinafter. At the rear of the storage compartment 22 is mounted a speaker 24, a momentary contact horn button 26 and a starter switch 28. The speaker 24 and switches 26 and 28 are appropriately interconnected with the electronics mounted on the circuit board 30 located within the storage compartment 22.

Batteries for powering the electronic circuitry may also be mounted within the storage compartment 22. However, in order to make it more convenient and simpler to replace the batteries, they are preferably mounted in a battery holder (not shown) located beneath the chassis 12.

As will be explained in more detail hereinafter, the sounds generated by the truck 10 and particularly the sound of the truck's internal combustion engine is varied in accordance with the speed at which the truck is pushed by the child. Furthermore, and as will also be described more fully hereinafter, the truck is provided with a back-up beeping sound which is automatically generated when the truck is moved in reverse, much like a real truck.

In order to provide the microcomputer with information concerning the speed and direction of movement of the truck 10, there is provided a speed and direction indicator 32. Indicator 32 is comprised essentially of a disk 34 which is secured to a shaft 36 held within a bushing 37. The bushing 37 is mounted to the vehicle chassis 12 so as to allow the shaft 36 to freely rotate with respect to the chassis 12. An 0-ring 38 comprised of a non-slip material is secured to the end of shaft 36 and contacts the upper surface of the truck wheel 16.

As a result of the arrangement described above, as the vehicle 10 is moved, wheel 16 rotates which, in turn, rotates O-ring 38 and, therefore, disk 34. The speed of rotation of disk 34 is proportional to the speed of rotation of the wheel 16 and, therefore, the speed of movement of the vehicle 10. Depending, of course, on the relative sizes of the wheels 16 and 0-ring 38, disk 34 may rotate at two or three times the speed of the rotation of wheels 16. But, in any case, the speed of rotation of disk 34 will always be directly proportional to the speed of the vehicle.

As best seen in FIGS. 1 and 2, the speed indicator 32 is preferably mounted under the hood section 20 of the vehicle. In order to accommodate the size of the disk 34, however, it is necessary to cut an opening such as shown at 40 in FIG. 5 in the upper wall of the chassis 12. Thus, the disk 34 lies both above and below the upper surface of the chassis 12 as seen most clearly in FIG. 3. A leaf-spring 42 secured to the upper surface of the chassis 12 by a screw or the like 44 rests on the bushing 37 and places a downward force on the 0-ring 38 which helps to maintain the same in contact with the wheels 16.

Figure 3:
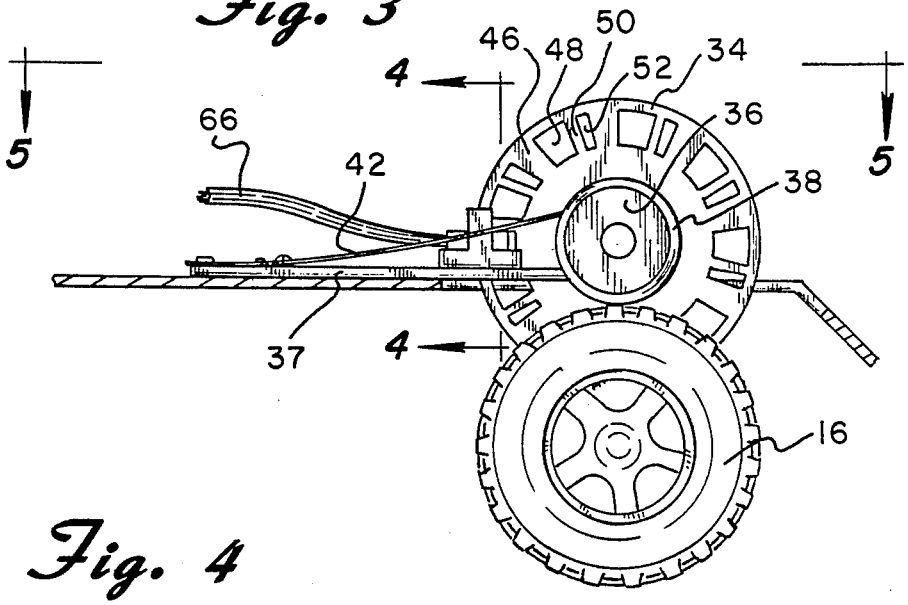
FIG. 3 is a cross-sectional view taken through the line 3—3 of FIG. 2.

As shown most clearly in FIG. 3, the periphery of the disk 34 includes a pattern thereon of openings which pass therethrough and solid portions. Viewing the disk 34 in FIG. 3 and proceeding clockwise, the preferred pattern on the disk 34 is a wide solid portion 46, a wide opening 48, a narrow solid portion 50 and a narrow opening 52. This pattern, of course, repeats itself around the periphery of the wheel.

For convenience, the wide solid portion 46 can be referred to by a capital "W." The wide opening 48 will be referred to as a lower case "w." The narrow solid portion 50 will be referred to as a capital "N" and the narrow opening 52 will be referred to as a lower case "n." Thus, the pattern described above when viewing disk 34 clockwise is W-w-N-n. It should be readily apparent that the pattern just described is asymmetrical. That is, if the wheel were turned in the opposite direction, the pattern would be w-W-n-N. As will be explained more fully hereinafter, the circuitry of the present invention is capable of recognizing and distinguishing between these two patterns. Thus, the microcomputer will be able to immediately recognize whether the truck is being moved in a forward or reverse direction. In order to more closely simulate a full-size truck, a back-up beeping noise can be automatically generated whenever the microcomputer senses that the truck is being moved in the reverse direction.

Figure 4:
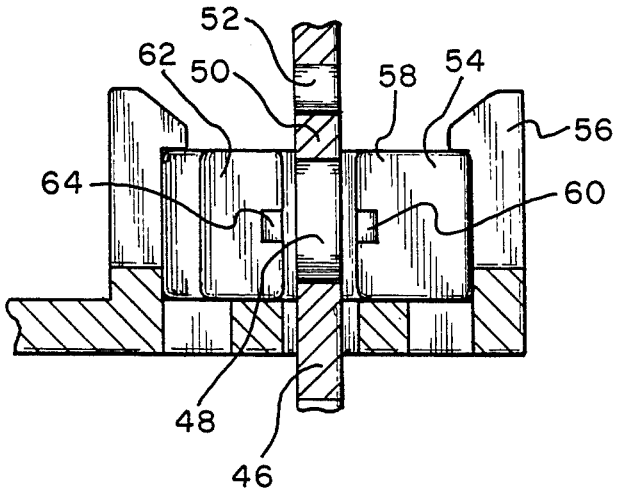
FIG. 4 is a cross-sectional view taken through the line 4—4 of FIG. 3.
Figure 5:
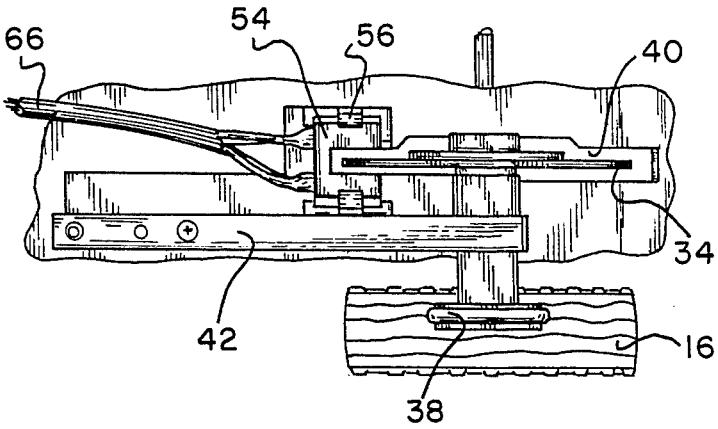
FIG. 5 is a top plan view of that portion of the vehicle shown in FIG. 3.

The openings 48 and 52 and solid portions 46 and 50 of the disk 34 are optically sensed by a photoelectric device 54 shown most clearly in FIGS. 4 and 5. Device 54 is held in place on the chassis 12 through the use of a socket or holder 56. As shown most clearly in FIG. 5, the device 54 is substantially U-shaped in cross section and fits around the peripheral edge of the disk 34. As seen in FIG. 4, one side 58 of the device 54 includes a light emitting diode 60 or the like therein which directs light toward the other side 62 and particularly toward a phototransistor or similar light sensor 64. Power to activate the diode 60 and the signal from the sensor 64 pass through cables 66 and to the circuit board 30 located within the storage compartment 22. It can thus be seen that whenever an opening such as 48 or 52 is in alignment with the diode 60 and sensor 64, the sensor 64 will generate a signal indicating that it has received light. Similarly, whenever a solid portion such as shown at 46 or 50 is in alignment with the diode 60 and light sensor 64, the output of the sensor 64 will be the reverse, indicating that there is no light.

The output from light sensor 64 is connected to the microcomputer and can be used to indicate both the direction of travel of the vehicle and the speed thereof. Obviously, the faster that the disk 34 rotates, the higher the on-off frequency of the sensor 64 and, thus, the higher the apparent speed. A particular problem can occur, however, if the vehicle is stopped with the disk 34 at a cusp, that is, at a point where only a portion of the light from the diode 60 is allowed to pass to the sensor 64. At this point, the photo sensor 64 would produce an output which is somewhere between "on" and "off." As is known, however, a microcomputer's input circuitry cannot sense a partial on or partial off. It must interpret the signal as either completely on or completely off. The inevitable small amount of noise in the signal can cause rapid switches in the interpretation which would lead the microcomputer to conclude that the disk 34 was rotating very fast.

Figures 7, 9:
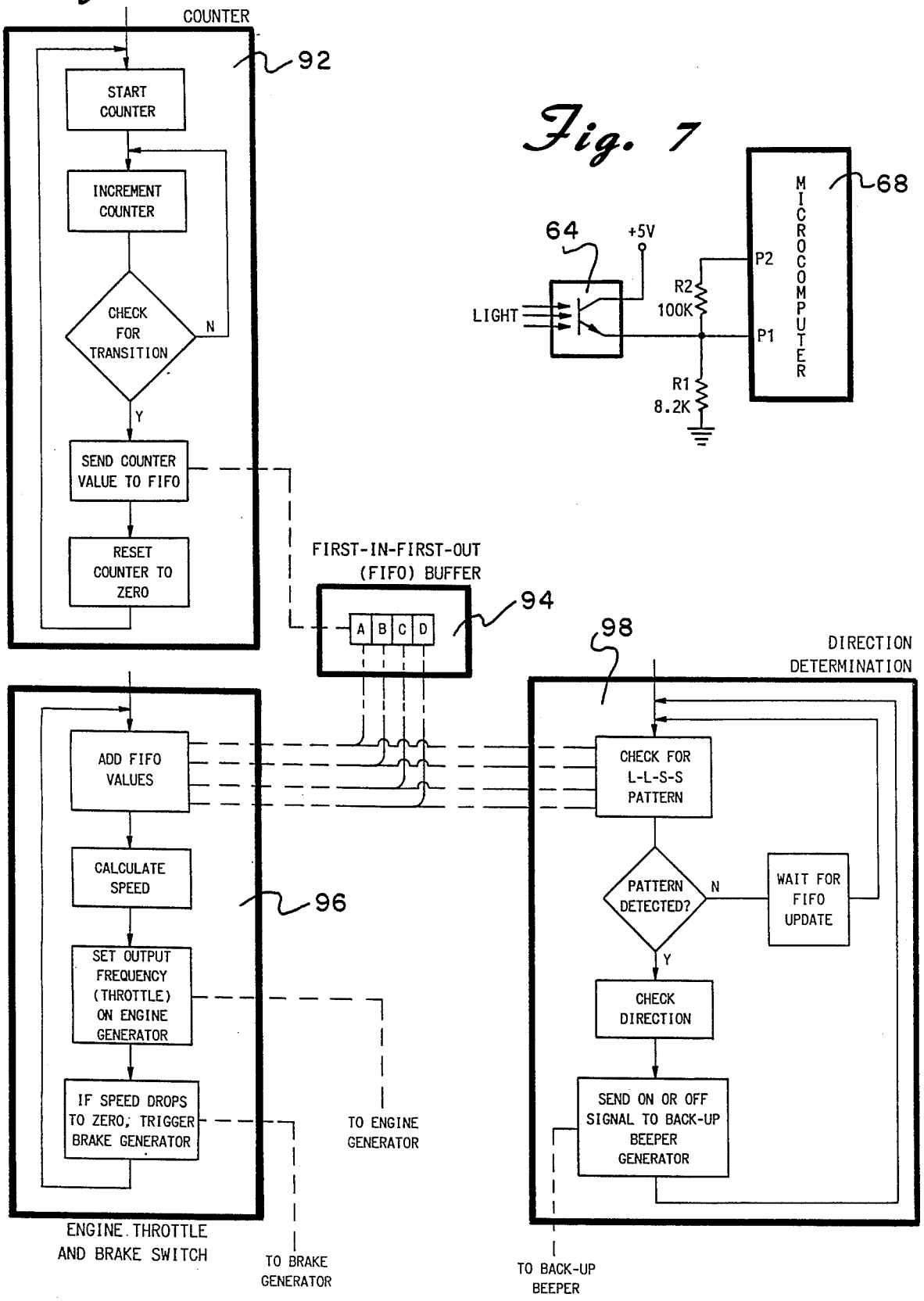
FIG. 7 is a schematic diagram of a hysteresis circuit used with the present invention.
FIG. 9 is a diagram further illustrating the speed and direction determining program.

Referring now to FIG. 7, to prevent the foregoing problem, a single resistor R2, connected to output pin P2 of the microcomputer 68, is used to implement a computer-controlled hysteresis. Phototransistor 64 acts as a switch which is turned on and off by light. When light from diode 60 is blocked by a solid segment of disk 34, phototransistor 64 turns "off" and the 8.2K resistor R1 holds input pin P1 of microcomputer 68 to ground. This input is clearly read as a "zero" by the microcomputer 68. When disk 34 is in a position such that an open segment is lined up with phototransistor 64, a large amount of light reaches phototransistor 64, turning it "on" and pulling the voltage at input pin P1 up to 5V. This input is clearly read as a "one" by the microcomputer 68. The transition between "one" and "zero" occurs when disk 34 partially blocks the light falling on phototransistor 64. In this case, phototransistor 64 may be considered partially turned on, and the resulting input voltage at input pin P1 is some value between zero and 5V. When the amount of light reaching phototransistor 64 produces a voltage at input pin P1 which matches the switching voltage of the microcomputer, the value read at input pin P1 will change between "zero" and "one." The aforementioned rapid switches in interpretation would normally occur if the disk 34 were to stop at a position where a voltage very close to the switching voltage was present at input pin P1.

To prevent such rapid switching, whenever the microcomputer 68 senses a change at input pin P1, an equivalent value is placed on output pin P2. For example, if the value on input pin P1 changes from "zero" to "one," the value of the output pin P2 will be set at "one" by the microcomputer 68. As will be obvious to one skilled in the art, setting P2 to "one" will raise the voltage at input pin P1 slightly, so that the voltage now applied to input pin P1 is above the aforementioned switching voltage Conversely, if the value on input pin P1 changes from "one" to "zero," the value of the output pin P2 will be set at "zero" by the microcomputer, thereby lowering the voltage applied to input pin P1 below the aforementioned switching voltage. Obviously, the additional operation of output pin P2 in conjunction with resistor R2 prevents the voltage present at input pin P1 from remaining fixed at a voltage such that the aforementioned noise would cause rapid switching of the digital value read from input pin P1.

In the preferred embodiment of the invention, the speed detector is in the form of the disk 34 with the various openings and solid portions at the periphery as shown. It should be understood, however, that this is by way of example only. In lieu of the openings 48 and 52, which allow light to pass therethrough, it would also be possible to provide a disk with a peripheral edge having high spots and low spots such as the cogs on a gear. These teeth or cogs could then be used to interrupt the light as the disk was rotating, i.e. to periodically allow light to pass from the source to the sensing means and to periodically interrupt the same as the disk or other element were rotated.

Furthermore, the particular pattern which is utilized is by way of example only. Any pattern which is asymmetrical, i.e. which would generate an asymmetrical signal from a light sensor when the rotating element were rotated in a forward or reverse direction, could also be utilized. Even further, it will be apparent that a disk is only one form of the invention and that substantially any other type of rotating element such as a cylinder or the like could also be used.

As pointed out above, one of the primary features of the present invention is the ability to create sounds which very closely resemble the sounds of a real full-size truck or other vehicle. Prior systems have merely simulated the actual sounds utilizing sound generators and the like. With respect to the horn and back-up beeping sounds generated by the truck 10, simulated sounds can be generated as it is not difficult to duplicate the sound of a horn or beeper. However, it is extremely difficult, if not impossible, to artificially generate the true sound of an internal combustion engine.

The present invention overcomes this problem by utilizing the actual sounds generated by a truck's internal combustion engine. This is accomplished by recording the actual sound of an internal combustion engine, digitizing the same and storing the digitized signal in the microcomputer 68. Since the sound of an internal combustion engine is a repetitive signal, it is not necessary to digitally record a long duration of such a signal. Rather, a short time period can be recorded, digitized and stored in the microcomputer 68 and this stored digitized signal is merely repeated by the microcomputer when it is desired to produce the sound of an internal combustion engine. Obviously, the digitized signal is first converted to an analog one by the digital to analog converter (DAC) 70 which analog signal is then amplified by amplifier 72 before it passes to the speaker or similar transducer 24. Further, and as should be readily apparent to those skilled in the art, the speed at which the digital signal is converted to an analog signal, and thus the pitch of the resulting engine sound, is determined by the microcomputer 68 after receiving a signal from the speed detector 32.

Other sounds such as the horn sound and beeper sound are also digitally stored in the microcomputer 68. These can either be real truck sounds that have been recorded and digitized or they can be artificially generated sounds that very closely resemble real sounds. In addition, the digital representation of other sounds, such as those generated by air brakes, can be generated by the microcomputer in real time as the toy is operated. In any case, when it is desired to emit one of these other sounds such as the horn, the horn button 26 is depressed and the stored digital signal from the microcomputer 68 passes to the digital to analog converter 70 so as to be amplified by amplifier 72 and emitted by speaker 24. Similarly, when the truck is moved in the reverse direction, the speed and direction detector 32 signals the microcomputer 68 to pass the digitally stored back-up beeper signal to the digital to analog converter 70, amplifier 72 and speaker 24. Because all of the various sounds are digitized, they can be easily digitally combined by the microcomputer 68 before being sent to the digital to analog converter 70. As a result of this arrangement, any two or more of the sounds capable of being emitted by the truck can be done simultaneously. Thus, a child can push the horn button 26 to sound the horn while the truck is being moved and is emitting the sound of the internal combustion engine.

Figure 6:
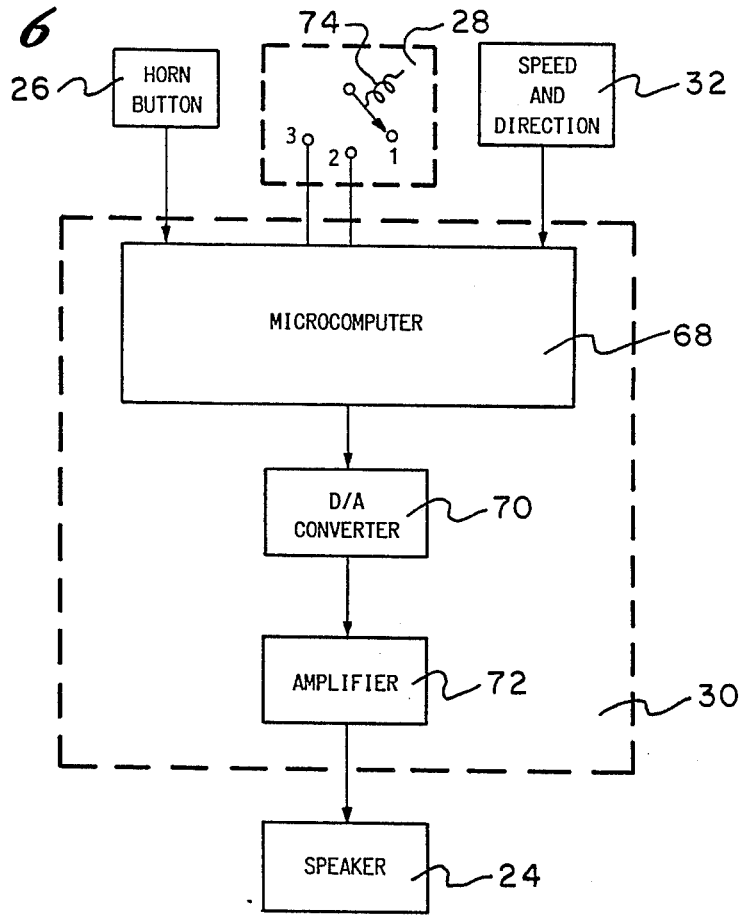
FIG. 6 is a rough schematic representation of the electronic circuitry of the invention.

The truck 10 of the present invention also closely simulates the sounds of a real truck in the manner in which the truck is started. In this regard, the starter switch 28 is preferably a three-position, manually operated switch which is shown schematically in FIG. 6.

In the first or off position which is fully counterclockwise as viewed in FIG. 2, the truck is off and no sounds are emitted from the speaker 24. The switch 28 can manually be moved into the second or on position. If released in this position, a switch detent (not shown) holds the switch in this position against the force of spring 74. When first moved into the on position, no sounds are emitted through the speaker 24. Rather, the system is merely readied. Switch 28 can then be manually moved into the third or start position against the force of spring 74, much like the starter or ignition switch of a real truck.

When the switch is moved into the start position, the microcomputer recognizes this and retrieves the digitally stored sound of an electric starter motor. When switch 28 is released, the force of spring 74 returns it to the second or on position, signalling the microprocessor to interrupt the starter motor sound and begin the internal combustion engine sound as described above. When the internal combustion engine sounds are first produced and since the vehicle would normally be in a stopped position, the actual sound being emitted by the speaker 24 would very closely resemble the sound of a truck's internal combustion engine at idle speed.

The microcomputer 68 is preferably an Intel 8051 although it is contemplated that various other microcomputers could also be used. The microcomputer 68 not only stores the digitized sound signals but is also utilized to control the operation of the electronics of the vehicle 10. This is, of course, accomplished by software which directs the operation of the microcomputer. The software controls the operation in accordance with the following. It will be obvious to one skilled in the art that a variety of microprocessors may be used to accomplish the functions described above.

Figure 8:
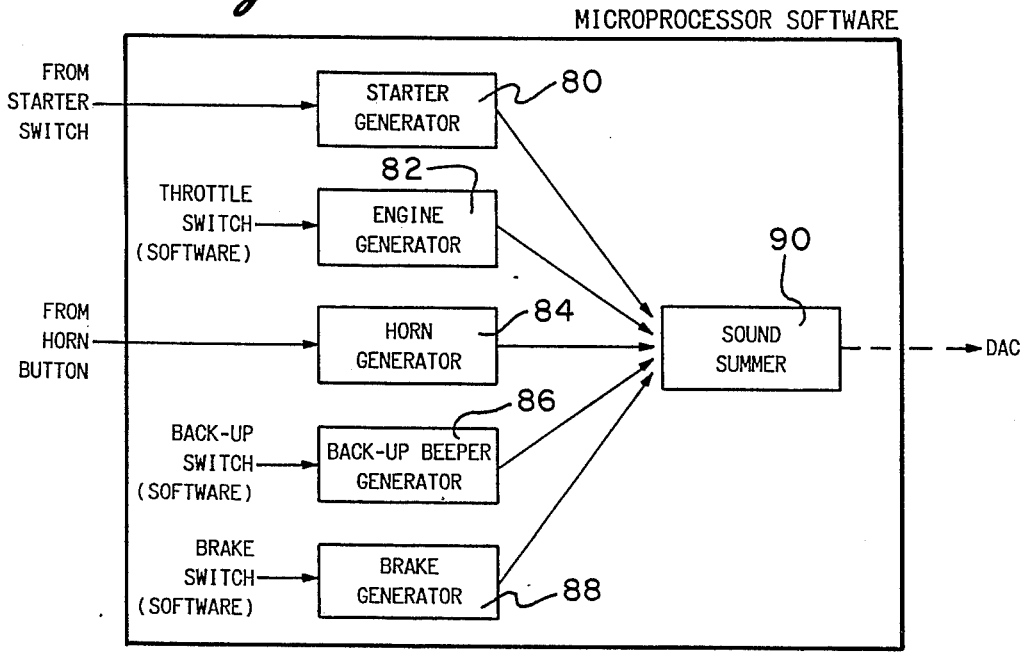
FIG. 8 is a diagram illustrating the microcomputer software.

FIG. 8 is a general description of the microcomputer software. The software includes five different sound generators including starter generator 80, engine generator 82, horn generator 84, backup generator 86 and brake generator 88. When turned on, each of these generators sends a sequence of digital values to the sound summer 90. With the exception of the brake generator 88, each of the sounds to be generated is stored in memory as a digital sequence of values. The sound generators fetch these digital values in sequence and send them, one by one, to the summer. When the end of the memory allocated to that sound is reached, the sound generator returns to the beginning of that sequence, as previously described.

The brake generator 88 is an exception to the above. When the brake generator is turned on, the software generates the digital values required to produce the air brake sound by calculating the digital values in real time.

Whenever the sound summer 90 receives a digital value, it digitally combines that value with any other values received. Whenever the digital value stored in the sound summer 90 changes, the sound summer 90 sends that value to the DAC 70 to be amplified by amplifier 72 and emitted by speaker 24. In this manner, sounds are combined with the end result being that several truck sounds can be heard simultaneously.

Each of the sound generators is turned on and off by a switch. In the case of the starter generator 80 and horn generator 84, these are hardware switches as previously described. The engine generator 82, backup generator 86, and brake generator 88 are all turned on and off by software switches. With the exception of the engine generator 82, whenever a generator is turned on, the corresponding digital sequence is sent to the sound summer 90 at a fixed frequency. For the engine generator, however, the frequency at which the digital values are sent to the sound summer 90 is determined by a software throttle. As this frequency increases, the pitch of the engine sound increases, producing a realistic change in sound corresponding to a real vehicle speeding up. Additionally, once the engine generator 82 has been turned on, it remains on throughout the operation of the toy.

FIG. 9 describes the software switches and throttle in greater detail. Before the throttle and switches can be set, the system must interpret the output from the light sensor 64. One portion 92 of the software accomplishes this using a counter running at a fixed frequency. This counter is initially reset to zero and then started. When the signal arriving from the light sensor 64 indicates a transition from off to on or on to off, the counter is stopped. Neglecting the varying widths of the disk 34 segments, obviously the value of the counter is inversely proportional to the speed of the disk.

This value is placed in the first position A of a four position first-in-first-out (FIFO) buffer 94. As will be familiar to those skilled in the art, all prior values are then shifted one position to the right, with the last value discarded. The counter is then reset to zero and restarted, and the process repeats.

The contents of the FIFO buffer 94 are then used by the engine throttle and brake switch portion 96 of the software. As a first step, the four values stored in the FIFO buffer 94 are added. The addition of the four values averages out the variations caused by the uneven segments of disk 34, since those segments form a pattern which repeats after every four segments. Once again, the larger the sum, the slower the disk and therefore vehicle speed. Therefore, the sum is used to set the output frequency of the engine generator, as previously described. If the speed falls to zero, the brake switch is triggered and the brake generator 88 is activated.

The contents of the FIFO buffer 94 are also used to determine the direction of the vehicle. As described earlier, the segment pattern on the disk is a repeating pattern which can be described as . . . W-w-N-n-W-w-N-n . . . when viewed with the disk turning in one direction and can be described as . . . w-W-n-N-w-W-n-N . . . with the disk turning in the opposite direction. For the disk turning at any given speed, a disk segment previously described as W or w will correspond to a relatively large value in the FIFO buffer 94. A disk segment previously described as N or n will correspond to a relatively small value in the FIFO buffer 94. Of course, the absolute value of these values will vary depending upon vehicle speed. However, it is obvious that for a given vehicle speed, the sequence of values which are placed in the FIFO buffer 94 will also form a pattern similar to that described above. The pattern of these values may be described as . . . L-L-S-S-L-L-S-S . . . where L refers to a relatively large value corresponding to a W or w segment, and S refers to a relatively small value corresponding to a N or n segment.

The direction checking portion 98 of the software then checks whether a L-L-S-S pattern is present in the FIFO buffer 94. It is apparent from observing the . . . L-L-S-S-L-L-S-S . . . that not every four elements will form a L-L-S-S pattern. For example, an L-S-S-L pattern is equally possible at any given time. The software checks for the L-L-S-S pattern by checking whether position C in buffer 94 contains a value less than half the value in position A and that position D contains a value less than half the value in position B. If that is the case the L-L-S-S pattern has been identified. If that is not the case, the software waits for the next update of the FIFO buffer 94 and then repeats the test. Once the L-L-S-S pattern has been identified, direction can then be determined. The software, at that time, looks at the output from the light sensor 64. If the output is zero, indicating a solid segment, the software assumes the vehicle is moving forward. If the output is one, indicating an open segment, the software assumes the vehicle is moving backward. Of course, the determination of whether zeros or ones indicates reverse depends on the physical orientation of the speed and direction indicator 32. Once the determination of direction is made, the backup beeper generator 86 can be triggered if the direction is reverse. Conversely, the backup beeper generator 86 is turned off if the direction is forward.

The present invention may be embodied in other specific forms without departing from the spirit or essential attributes thereof and accordingly reference should be made to the appended claims rather than to the foregoing specification as indicating the scope of the invention. Obviously, such other forms may include vehicles, and accompanying sounds, other than tractor trailer trucks, such as fire engines, police and emergency vehicles, as well as other vehicles not here contemplated.

I claim:

1. In a toy wheeled vehicle including electronic sound generating means for generating a sound which varies in relation to the speed at which the vehicle is moved, the improvement comprising means for determining the direction in which the vehicle is moving including means for generating an asymmetrical electrical wave form in response to movement of the vehicle.

2. The invention as claimed in claim 1 wherein said determining means determines whether said vehicle is moving in a forward or reverse direction.

3. The invention as claimed in claim 2 further including means for generating a second sound different from said first-mentioned sound when said determining means determines that said vehicle is moving in a reverse direction.

4. In a toy wheeled vehicle including electronic sound generating means for generating a sound which varies in relation to the speed at which the vehicle is moved, the improvement comprising:

means for determining whether said vehicle is moving in a forward or reverse direction, and means for generating a second sound different from said first-mentioned sound when said determining means determines that said vehicle is moving in a reverse direction, said second sound being generated concurrently with said first-mentioned sound.

5. The invention as claimed in claim 4 wherein said first-mentioned sound represents the noise of an internal combustion engine.

6. The invention as claimed in claim 4 further including a rotating element adapted to rotate at a speed proportional to the speed of said vehicle and wherein said means for determining direction includes portions of said element having dissimilar properties arranged in an asymmetrical pattern on said element.

7. In a toy wheeled vehicle including electronic sound generating means for generating a sound which varies in relation to the speed at which the vehicle is moved, the improvement comprising means for determining the direction in which the vehicle is moved and a rotating element adapted to rotate at a speed proportional to the speed of said vehicle; said means for determining direction including portions of said element having dissimilar properties arranged in an asymmetrical pattern on said element, said portions including a plurality of openings passing through said element.

8. In a toy wheeled vehicle including electronic sound generating means for generating sounds corresponding to the sounds of a full size vehicle from which the toy is modeled, the improvement comprising:

a solid state microcomputer including a memory and having actual vehicle sounds digitally stored in said memory;

digital to analog signal converting means for converting said stored digital sounds into an analog signal; 'transducer means connected to the output of said analog to digital converter means;

sensing means for determining the speed at which said toy vehicle is moved, said sensing means including an on-off switching element connected to said microcomputer and disposed to provide switching input to said microcomputer at intervals corresponding to predefined units of said movement, and means including said solid state microcomputer for varying said generated sounds in response to said movement.

9. The invention as claimed in claim 8 wherein a plurality of different sounds are digitally stored in said memory and including means for digitally combining said different stored digital sounds prior to being converted to an analog signal by said converting means.

10. The invention as claimed in claim 8 further including means for controlling when said sounds are to be generated and for varying said sounds.

11. The invention as claimed in claim 10 wherein said means for controlling and said means for varying is comprised of said solid state microcomputer.

12. The invention as claimed in claim 8 further including means for generating synthesized sounds in digital form in addition to said digitally stored sounds and means for digitally combining said synthesized sounds and said stored sounds.

13. The invention as claimed in claim 12 further including manually operable switching means and means including said solid state microcomputer for controlling the sounds to be generated in response to said switching means.

14. The invention as claimed in claim 8 wherein hysteresis is added to the output of said switching element such that the position of travel of said movement at which said switching element turns on when said vehicle moves in a forward direction is always offset from the position of travel of said movement at which said switching element turns off when said vehicle moves in a reverse direction.

15. In a toy wheeled vehicle including electronic sound generating means for generating a sound which varies in relation to the speed at which the vehicle is moved and including means for developing a signal corresponding to the speed of said vehicle, the improvement in said developing means comprising:

a rotatable element adapted to rotate at a speed proportional to the speed of said vehicle;

a light source directed on one surface of said element and a light sensing means position so as to face an opposite surface thereof;

said element being so configured so as to periodically allow light to pass from said source to said sensing means as said element rotates.

16. The invention as claimed in claim 15 wherein said element has a plurality of holes therein through which said light can pass as said element rotates.

* * * * *